US008672577B2

(12) United States Patent
Wojtowicz et al.

(10) Patent No.: US 8,672,577 B2
(45) **Date of Patent: *Mar. 18, 2014**

(54) INSIDE WRAP POST COUPLER ACCOMMODATING BEAM RIVET

(75) Inventors: David J. Wojtowicz, Orland Park, IL (US); Thomas St. Germain, Bridgeview, IL (US); Mitchell Liss, Northbrook, IL (US); Al Dunaj, Chicago, IL (US)

(73) Assignee: Edsal Manufacturing Company, Inc., Chicago, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/184,507

(22) Filed: Jul. 16, 2011

(65) Prior Publication Data

US 2011/0272542 A1 Nov. 10, 2011

Related U.S. Application Data

(63) Continuation-in-part of application No. 11/044,689, filed on Jan. 27, 2005, now Pat. No. 8,585,313.

(51) Int. Cl.

| | |
|---|---|
| ***B25G 3/00*** | (2006.01) |
| ***E21B 17/043*** | (2006.01) |
| ***F16D 1/00*** | (2006.01) |

(52) U.S. Cl.

USPC ..... 403/286; 403/295; 211/191

(58) Field of Classification Search

USPC ..... 403/109.2, 109.8, 283, 286, 192, 293, 403/300, 305, 353, 393; 211/182, 189–192, 211/194; 52/582.1, 848; 256/47, DIG. 5

See application file for complete search history.

(56) References Cited

U.S. PATENT DOCUMENTS

| | | | | | |
|---|---|---|---|---|---|
| 2,226,763 | A * | 12/1940 | Geib et al. | ..... | 446/116 |
| 3,056,507 | A * | 10/1962 | Squires, Jr. et al. | ..... | 108/106 |
| 4,598,512 | A * | 7/1986 | Chapman | ..... | 52/165 |
| 4,967,916 | A * | 11/1990 | Handler et al. | ..... | 211/187 |
| 6,209,155 | B1 * | 4/2001 | Epstein et al. | ..... | 5/201 |
| 6,397,413 | B2 * | 6/2002 | Epstein et al. | ..... | 5/201 |
| 6,679,393 | B1 * | 1/2004 | Weaver et al. | ..... | 211/192 |
| 6,839,920 | B2 * | 1/2005 | Schulte | ..... | 5/200.1 |
| 6,971,175 | B2 * | 12/2005 | Savoy et al. | ..... | 29/897.2 |

* cited by examiner

*Primary Examiner* — Daniel P. Stodola
*Assistant Examiner* — Nahid Amiri
(74) *Attorney, Agent, or Firm* — Wood, Herron & Evans, LLP

(57) ABSTRACT

A post coupler is provided with a pair of coupler flanges having rivet receiving apertures for receiving rivets extending from horizontal shelf-supporting beams to facilitate vertical shelf placement in a shelving unit unfettered by the vertical disposition of the post couplers. Apertures in the coupler index with apertures in abutting corner post sections to permit rivet extension therethrough. The reverse bend flanges of the coupler have a length shorter than the overall length of the coupler and wrap around edges of post sections, to be coupled, from the inside to the outside.

9 Claims, 8 Drawing Sheets

INSIDE WRAP POST COUPLER ACCOMMODATING BEAM RIVET

PRIORITY CLAIM

This application is a Continuation-in-Part of U.S. patent application Ser. No. 11/044,689, filed Jan. 27, 2005 (now U.S. Pat. No. 8,585,313), published under Publication No. US2006/0163438, both of which are incorporated herein by reference in their entirety.

RELATED PATENT APPLICATIONS

This application is related to co-pending applications filed on even date herewith and including:

U.S. application Ser. No. 29/397,486 entitled "DESIGN FOR WRAPPED POST COUPLER";

U.S. application Ser. No. 29/397,490 entitled "DESIGN FOR POST COUPLER WITH SCALLOPED EDGES";

U.S. application Ser. No. 29/397,488 entitled "DESIGN FOR POST COUPLER WITH KEYHOLE OPENING";

U.S. application Ser. No. 13/184,506 entitled "OUTSIDE WRAP POST COUPLER ACCOMMODATING BEAM RIVET";

U.S. application Ser. No. 29/397,487 entitled "DESIGN FOR POST COUPLER WITH INSIDE WRAP";

U.S. application Ser. No. 29/397,485 entitled "DESIGN FOR POST COUPLER WITH SCALLOPED EDGES AND INSIDE WRAP";

U.S. application Ser. No. 29/397,489 entitled "DESIGN FOR POST COUPLER WITH KEYHOLES AND INSIDE WRAP";

U.S. application Ser. No. 13/184,511 entitled "INSIDE WRAP POST COUPLER WITH ASSEMBLY ASSIST"; and U.S. application Ser. No. 29/397,491 entitled "DESIGN FOR INNER POST COUPLER".

All these related applications are herewith expressly incorporated herein by reference as if fully set out herein.

FIELD OF THE INVENTION

This invention relates to shelving and post couplers used in coupling shelf supporting columns end-to-end and accommodating horizontal shelf-supporting beams.

BACKGROUND OF THE INVENTION

Prior post couplers have been used to couple post ends together to form an elongated, unitary corner post or column used with other corner posts to support a plurality of shelves mounted on elongated brackets or beams connected to and extending horizontally between the corner posts. Typically, the posts are of angled construction defined by flanges at 90° to each other and are provided with keyhole-shaped slots for receiving rivets extending from the elongated shelf beams which are oriented horizontally between the posts. The rivets interlock the beams to the posts to define a ladder-like shelf frame on which shelves are supported.

These beams can thus be adjusted vertically, up and down the posts, to provide for a desired vertical spacing between shelf members supported by the beams. This range of vertical adjustability is limited, however, by the post couplers, which serve to interconnect post members in vertical alignment to form a unitary post used as a column.

It will be appreciated that in a shelving apparatus formed by composite posts which are defined by two or more post sections, coupled end-to-end by such couplers, the length of the couplers is typically long enough that the coupler covers at least two levels of rivet-receiving keyhole slots in each of two adjacent post members. The prior couplers then cover, mask or obstruct four levels of slots in the assembled post. This prevents location of shelf-supporting brackets at the vertical height where the post members are joined by the couplers, since no beam supporting rivets can be extended through slots of the post at the ends of the vertical post members and which are covered by the couplers. There is thus a vertically-oriented void area in a prior shelving unit defined by the vertical extent of the useful, but slot-blocking, post couplers.

In a related application, there is provided a post coupler of an outside wrap configuration wherein the coupler wraps around post sections edges from the outside to inside reverse bend flanges of the coupler and is provided with rivet receiving apertures indexed with like apertures in the post sections and to accommodate universal beam mount even at the coupler locations. In instances where alternative couplers which wrap around post edges from the inside to outside reverse bend flanges, it is desired to provide improved couplers of this configuration which also accomplish universal or unlimited beam mounting even at the coupler positions.

Accordingly, it is desirable to provide a shelving unit with an unlimited vertical spacing capacity for the shelves where the corner posts are each defined by at least two end-to-end post members joined by a coupler disposed on the inside of the post members and which wraps around post edges from the inside to reverse bend flanges disposed along the outside of the post members.

A further objective of the invention has been to provide a post coupler in combination with corner post members in a shelving unit wherein the couplers may be integrated with the shelf-supporting beams to provide unlimited vertical positioning of the shelf along the length of the shelving unit corner posts, whether mounted on the inside or outside of the coupled post members.

A further objective of the invention has been to provide an inside-to-outside wrap post coupler for accommodating the horizontal shelf supporting beams at their interface with shelf unit corner posts.

SUMMARY OF THE INVENTION

To these ends, a preferred embodiment of the invention contemplates a shelving unit having corner posts, each comprising at least two corner post members coupled end-to-end with a post coupler and a plurality of shelf-supporting beams coupled to the corner posts via fasteners, the post coupler having apertures aligned with fastener-accepting apertures in the respective corner post members for receiving such fasteners, wherein the beams can be connected along the corner posts at selected positions, including positions traversed by the post couplers of the corner posts. Apertures in the post coupler are indexed or aligned with apertures in adjacent corner post members so the aperture spacing in the couplers is cooperative with the spacing of apertures in the connected-together corner post members.

Moreover, in a preferred coupler embodiment, the coupler has two main flanges and two outwardly directed, reverse bend flanges for disposition around edges of the post sections from the inside around to the outside. These reverse bend flanges are of such limited width that they do not extend across any portions of the apertures in either the coupler or the post section. In this way, such inside wrap couplers provide for unobstructed pass-through of the rivets extending from the beams into and through the couplers and the posts. For purposes of this application, the term "inside wrap" as applied to post couplers refers to post couplers having major coupler flanges and additional reverse bend flanges extending from the major flanges and wrapping around post edges from the inside of the post section to the outside thereof. Specifically, the reverse bend flanges are oriented proximate outside surfaces of the respective post sections as shown in the drawings.

In one embodiment of a shelving unit provided with such coupler, a beam is disposed to interface with a post or coupling on the interior side thereof. In another embodiment, the beam is disposed on one exterior side of the coupling post.

These and other features and advantages of the invention will be further readily understood from the following written description and from the drawings in which:

DETAILED DESCRIPTION OF THE INVENTION

Turning now to the drawings and in particular, to FIGS. 1-7, one embodiment of the invention comprises a shelf unit 10 having a plurality of shelves 11-16. Four composite corner posts or columns 17-20 define the corners of unit 10. Each post 17-20 comprises at least two post sections (could be more) joined by a coupler as at 21.

Figure 1:
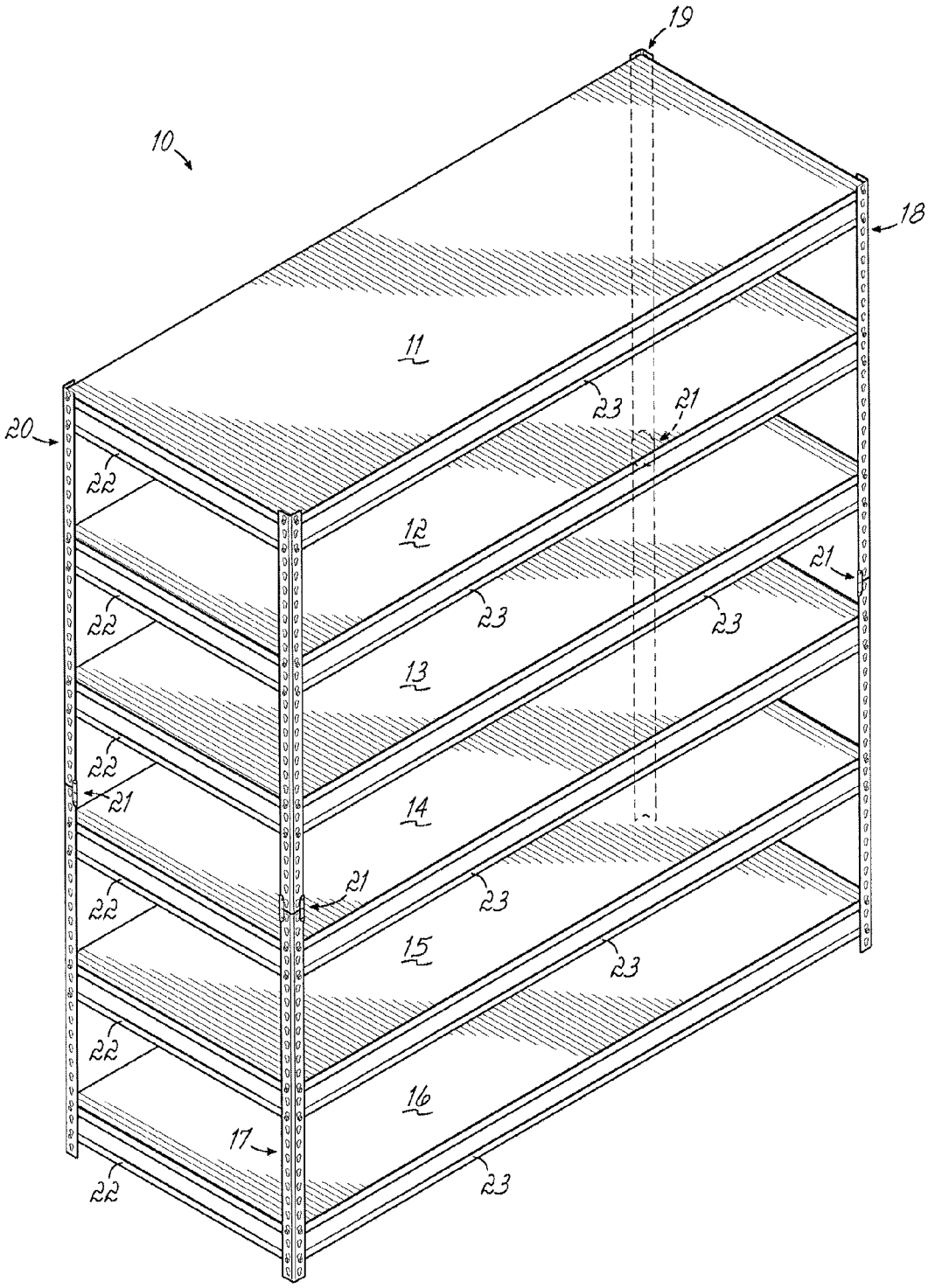
FIG. 1 is an isometric view of a shelving unit according to the invention.

Each shelf 11-16 is supported by four horizontally-oriented shelf-supporting brackets or beams as at side beams 22, and front and rear beams 23, with front and rear beams 23 being longer than side beams 22. The rear beam and offside beams not shown in FIG. 1 are respectively identical to the front (23) and side (22) beams as shown in FIG. 1. Side beams 22 on one hand and the front/rear beams 23 on the other hand differ essentially only in length and are otherwise identical.

For purposes of this application, the terms "inner" or "inside" or "interior" refer to the post or coupler as viewed from within a shelving unit. The terms "outer" or "outside" or "exterior" refer to the posts or couplers as viewed from without a shelving unit.

Figure 2:
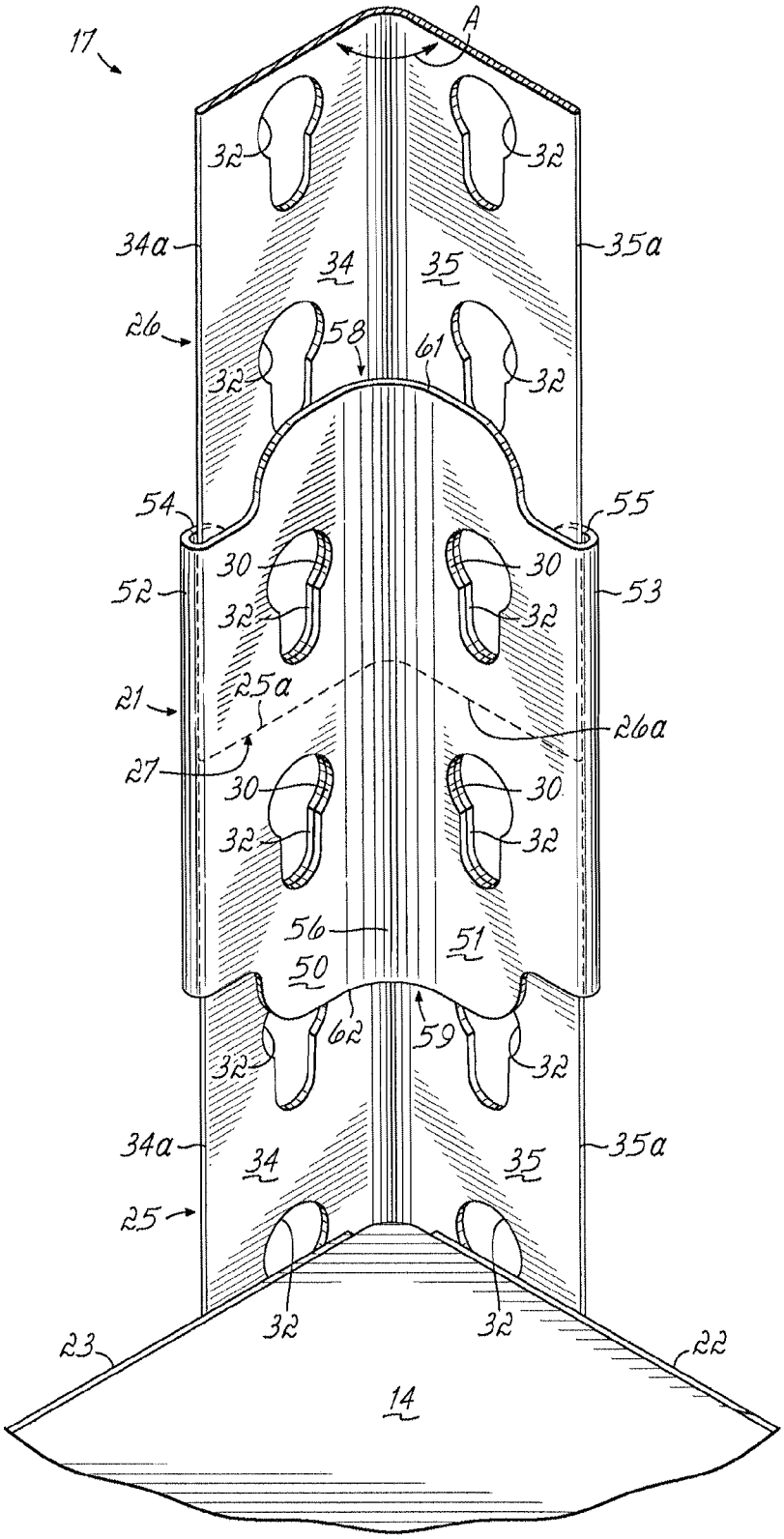
FIG. 2 is an enlarged isometric view of a portion 2 of FIG. 1 from the interior area of the shelving unit and at the juncture of post sections and coupler.

With attention to FIG. 2, there is shown from the perspective of the interior of the unit 10 a representative corner structure as at post 17, comprised of lower post section 25 and upper post section 26, coupled in end-to-end abutting relationship via coupling or coupler 21 to form the unitary post 17. The posts 17-20, post sections 25, 26, coupling 21, and the end structure of the beams at each corner of unit 10 are essentially identical, so only one corner structure, coupler, post section and beam intersection as in FIGS. 2 and 3 will be described.

Each lower and upper post section 25, 26 is in the form of an angle and is provided with a series of keyhole-shaped apertures 32 as shown, in each flange thereof, each aperture preferably identically spaced in each post section, one from the other. Preferably, the endmost aperture 32 in each post section 25, 26 is spaced from the section ends at one-half pitch so that when sections 25, 26 are abutted as at junction 27, the two endmost apertures 32 are spaced from each other at the same pitch as each aperture 32 is spaced from other apertures 32 in the same post section 25, 26. Apertures 30 and 32 have enlarged and narrower portions as shown.

Figure 3:
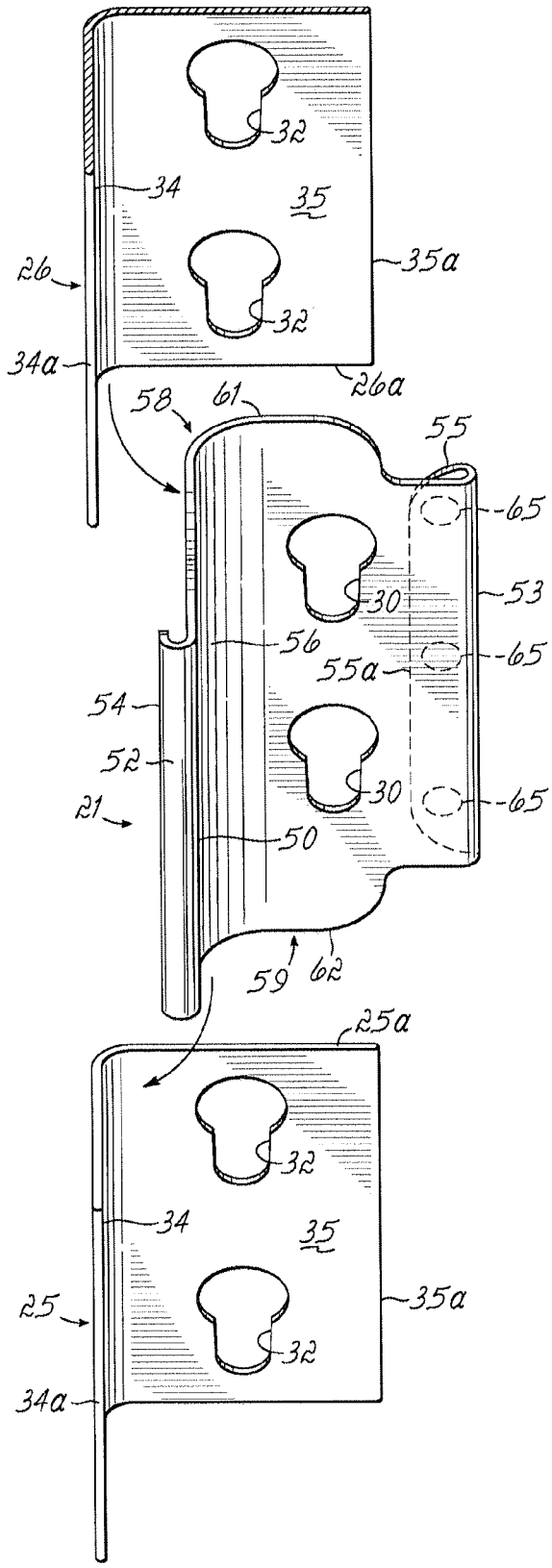
FIG. 3 is an exploded isometric view of the components of FIG. 2, excluding the shelf.
Figure 4:
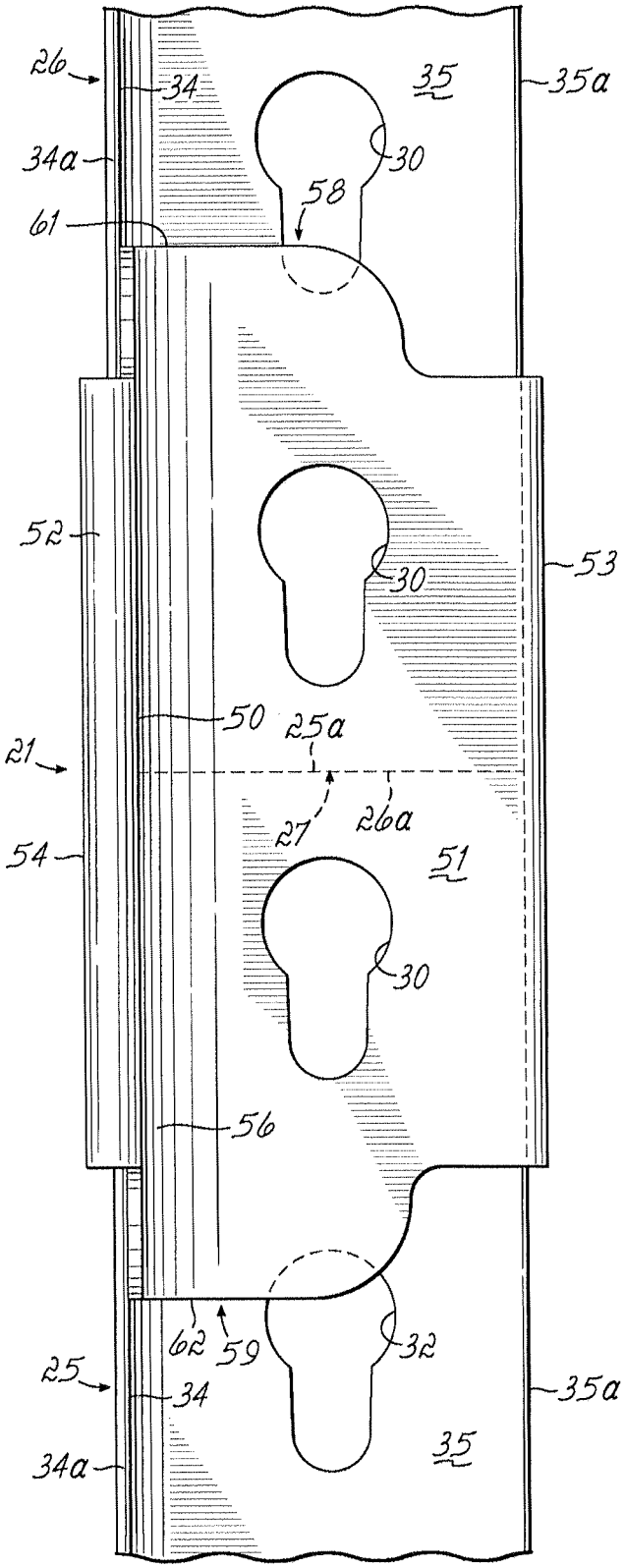
FIG. 4 is an elevational view of the components of FIG. 2 from the interior of the shelving unit.
Figure 5:
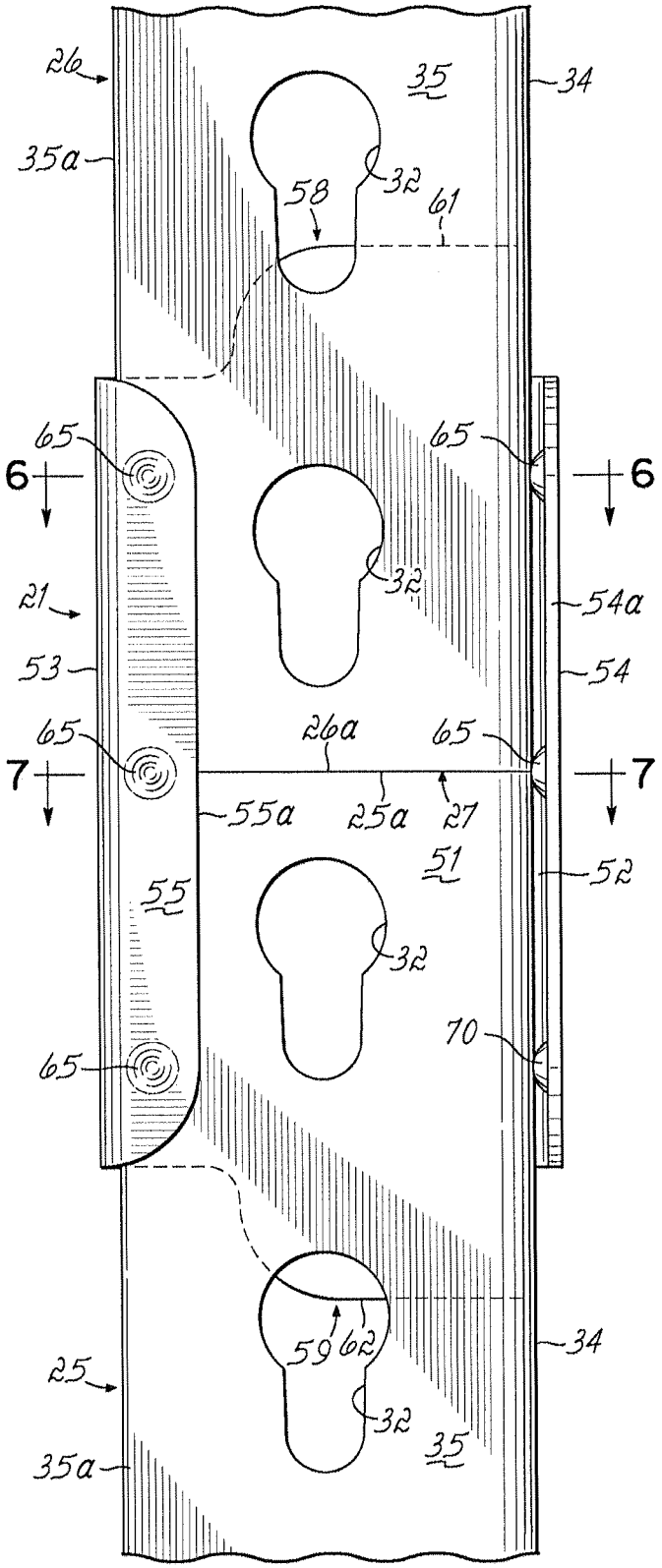
FIG. 5 is an elevational view of the components of FIG. 2 from the exterior of the shelving unit.

Each post section 25, 26 is preferably in the form of an angle, formed by two post flanges 34, 35 at a preferred included angle A of about 90° with respect to each other. Each post flange has an elongated edge 34*a*, 35*a* as shown. Each post section 25, 26 has a respective post section end 25*a*, 26*a* as shown in FIG. 3.

Post sections 25, 26 preferably abut each other end-to-end at section ends 25*a*, 26*a* defining junction 27.

As noted, beams 22, 23 are generally identical except for length in this embodiment; the length of such beams being variable to accommodate the width and depth of a desired shelving unit 10. Beams 22, 23 each incorporate, as best seen in FIGS. 8 and 9, a beam web 40, an upper reverse bend at 41, an upper vertical flange 42, a lower vertical flange 44, and a 90' bend from flange 42 defining a shelf-supporting flange 43, all as clearly shown in FIGS. 8-9.

Figure 8:
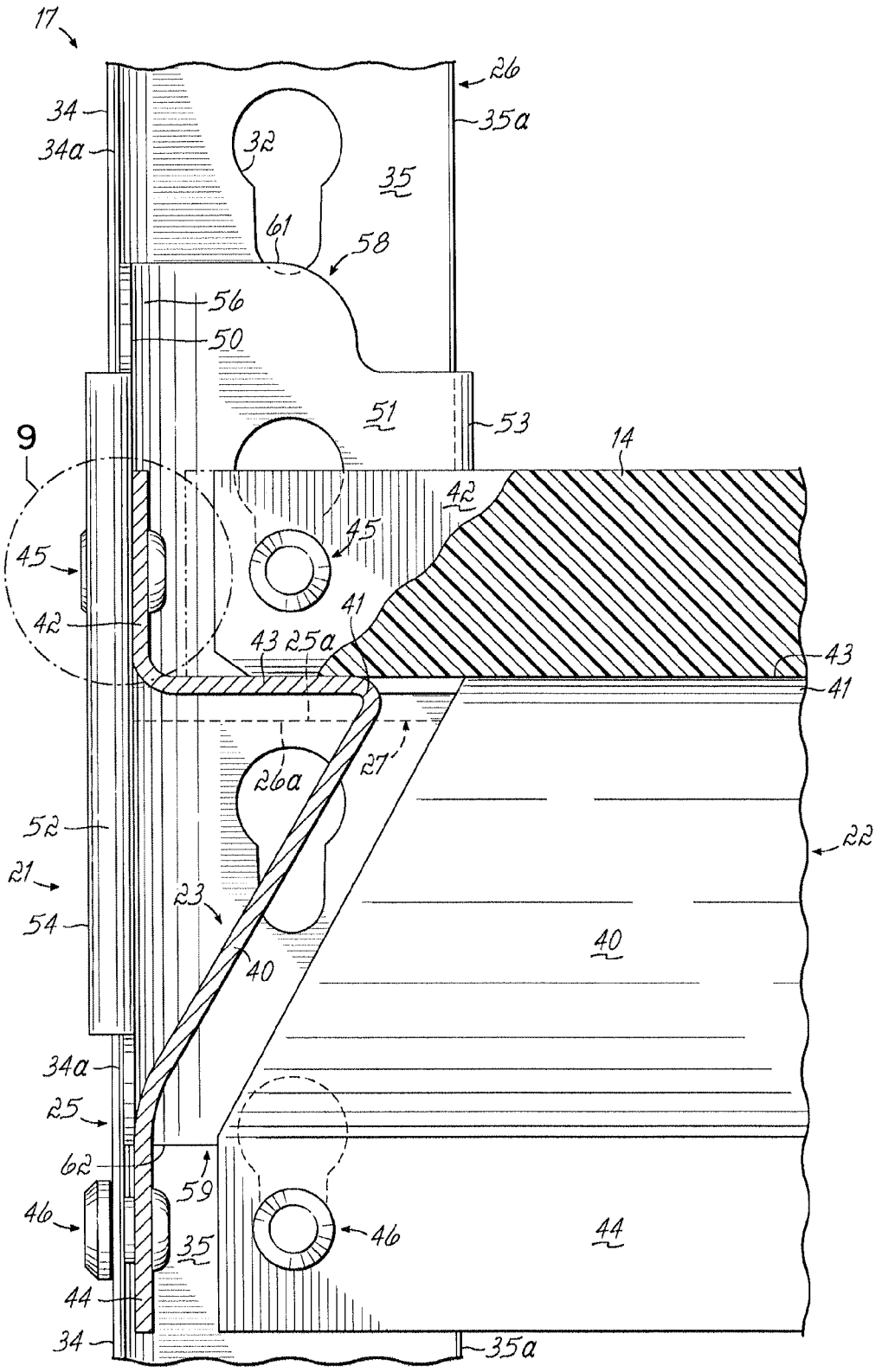
FIG. 8 is an elevational view in partial cross-section similar to FIG. 4 but showing preferably inside mounted beams and shelf therein in combination with the elements of FIG. 4.
Figure 9:
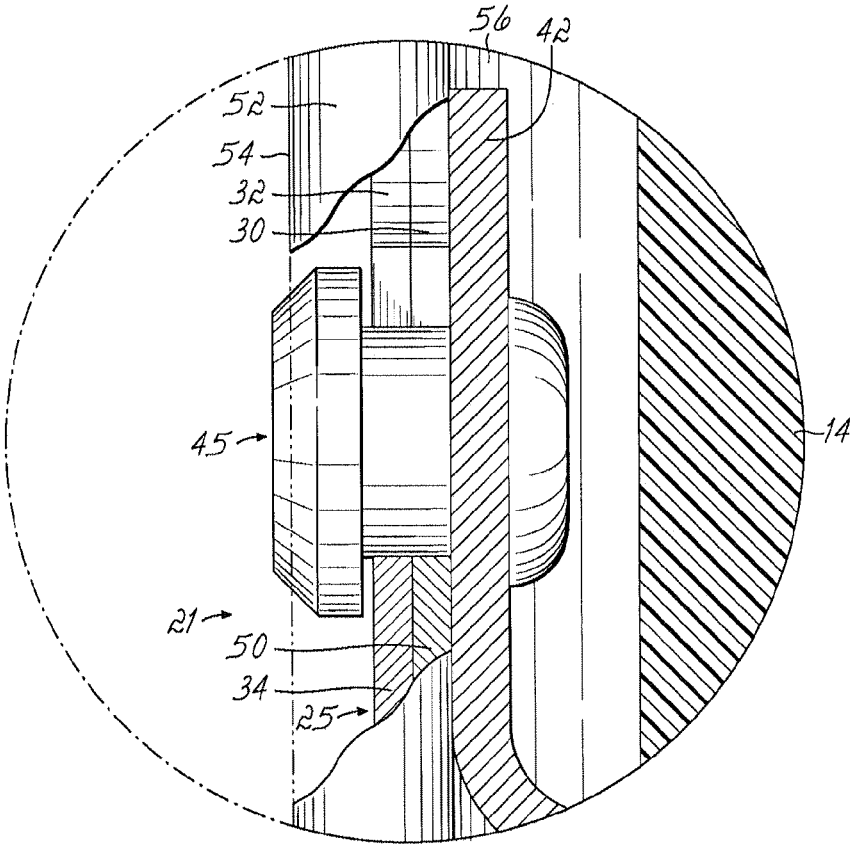
FIG. 9 is an enlarged view in partial cross-section of the encircled area 9 of FIG. 8

Shelf-supporting flanges 43 are relieved or tapered at an angle, as shown in FIG. 8, in a direction away from the beam ends, so as not to interfere with any proximate beam end.

Each beam 22, 23 is provided proximate its ends, with two beam supporting lugs or rivets 45, 46, one above the other. The views of FIGS. 8 and 9 illustrate one suitable shape of the respective rivets 45, 46.

For purposes of this embodiment, it will be appreciated the spacing of the upper and lower rivets 45, 46 is equal to twice the distance between the sequential apertures 30, 32, respectively. In other words, the rivets in this embodiment are spaced vertically apart at a distance twice that of the pitch between vertical apertures, one from the next, in the couple and post, as shown in FIGS. 8 and 9.

Upper rivets 45 extend through apertures 30 in coupling 21 and through respective holes 32 in the post end sections 25*a*, 26*a* described above, and as will be described.

Post coupling 21 is best seen in FIGS. 2-7. The coupling 21 comprises two major integral coupler flanges 50, 51 disposed at an included angle (at bend 56) to each other at preferably 90°, preferably similar to angle A between the post flanges 34, 35.

Each major flange 50, 51 has a reverse bend or fold 52, 53 and an inwardly directed reverse bend flange 54, 55 respectively turned inwardly, from flange bends 52, 53. Each flange 54, 55 lies parallel to the respective flanges 50, 51 from which they extend, and on the outside thereof.

Figure 6:
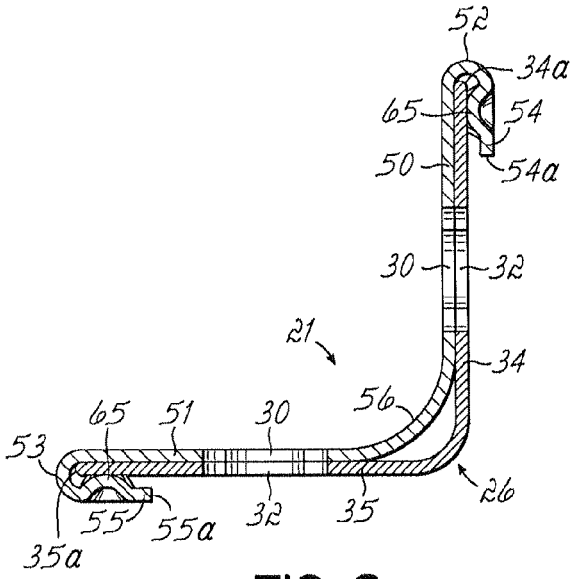
FIG. 6 is a cross-sectional view taken along lines 6-6 of FIG. 5.
Figure 6A:
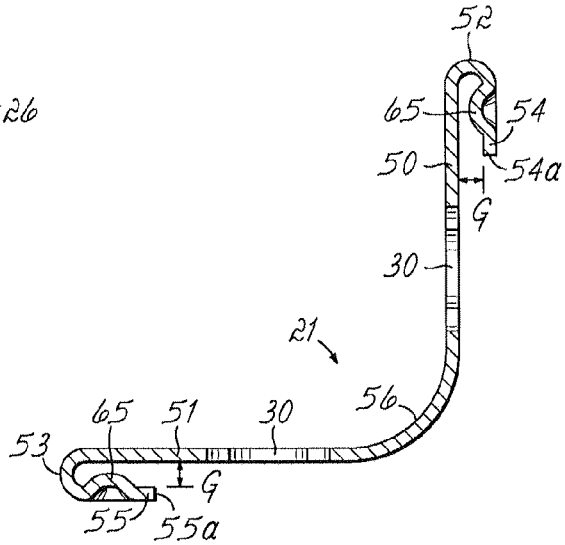
FIG. 6A is a view like that in FIG. 6 but omitting the post section for clarity.
Figure 7:
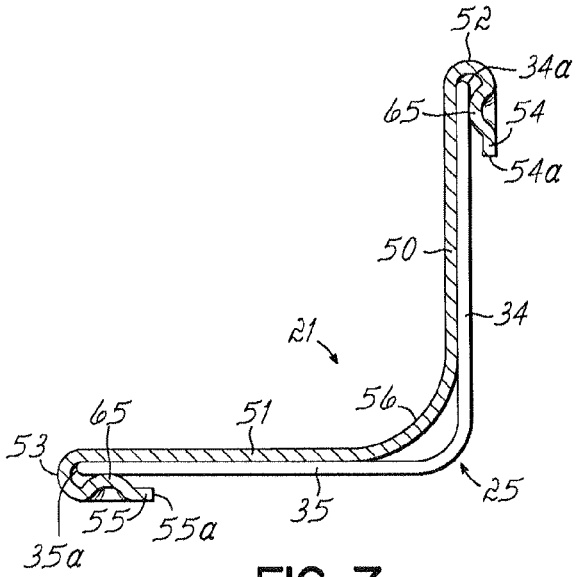
FIG. 7 is a cross-section view taken along lines 7-7 of FIG. 5.

A gap G is defined between the respectively adjacent flanges 50, 54 and 51, 55 respectively, this gap being approximately equal to the thickness of post flanges 34, 35 respectively. See FIG. 6A.

At each end of the bend 56, the coupler 21 includes an extended projection 58, 59 projecting outwardly from the ends of major coupler flanges 50, 51 at bend 56. The ends of the respective projections define the length of the coupler 21. The projections 58, 59 have tapered or cured edges 61, 62.

The keyhole-shaped apertures 30, as shown, of the coupler, are oriented in flanges 50, 51 one above the other respectively, at the same distance or pitch as separate apertures 32 in the post end sections 25*a*, 26*a*. Apertures 30 are preferably in the same shape as apertures 32 in the post sections 25, 26.

Coupler 21 is also provided with a plurality of detents or projections 65 (FIG. 5) in the respective reverse bend flanges 54, 55. These extend inwardly into the respective gaps G, and serve to frictionally engage post end sections 25*a*, 26*a* in gaps G when the post end sections are inserted into the coupler 21.

In this regard, it will be appreciated the projections 58, 59 serve to aid in the introduction of respective post end sections 25*a*, 26*a* into the coupler 21. Thus, projections 58, 59 serve to help guide and facilitate the introduction of the post sections into coupler 21.

In use, a post section 25, 26 is introduced to coupler 21 at slight angle thereto. Engagement of ends 25*a*, 26*a* with the coupler 21 tend to slide over or along the coupler projection 58 or 59 and continue the joining motion of these components without hanging up one against the other, thus facilitating engagement and positioning of the post section into the coupler, i.e. the post flange edges are easily guided into the gaps G.

Projections 58, 59 extend from coupler flanges 50 and 51 respectively, at opposite ends of the coupler, the distance between their outermost edges defining an overall coupler length. It will be appreciated that the respective reverse bend flanges 54, 55 are shorter longitudinally than said overall length, each terminating short of an end of the coupler defined by the projection. In other words, while the reverse bend flanges extend along major flanges 50, 51, they terminate short of the overall coupler length.

Finally, note the reverse bend flanges 54, 55 have respective edges 54*a*, 55*a*. These define the inward extent of flanges 54, 55 (FIG. 5) so the flanges 54, 55 do not extend over and block apertures 30 or 32. The reverse bend flanges 54, 55 thus do not subtend apertures 30 or 32, as would block them for passage of rivets 65.

Turning now to the relationship of the components as coupled and connected in an erected shelving unit. FIGS. 2-9 reflect such a unit where the beams 22, 23 are disposed on the inside of post sections 25, 26 (and posts 17-20).

In FIGS. 2-8, beams 22, 23 are located inside posts 17-20. Coupler 21 is disposed substantially on the side of the posts against post flanges 34, 35, with bends 52, 53 wrapped around edges 34*a*, 35*a* of the post sections. FIG. 2 broadly illustrates this embodiment while remaining FIGS. 3-8 show its details.

Referring to FIGS. 2-5, coupler 21 is disposed proximate the bottom end 26*a* of upper post section 26, coupler 21 in secure contact with post section 26. Detents 65 frictionally engage and hold post section 26*a* in gap G, it being appreciated there is some flexibility in flanges 54, 55. Webs 40 of beams 22, 23 lie against coupler flanges 50, 51 respectively.

Rivets 45 (FIGS. 8, 9) extend through beams 22, 23 and coupler flanges 50, 51 respectively and post section 26. Interior rivet heads seat on flanges 42 of the beams. Exterior rivet heads are positioned to pass through the enlarged portions of the post section 26 and coupler 21, allowing rivet shanks to seat in the narrower sections of apertures 30 and 32, securing the components together. The exterior rivet heads rest against those outer surfaces of post section 26 flanges 34, 35.

Lower rivets 46 have a similar orientation. They extend from the outer surface of the post flanges and through lower flange 44 of a beam. It will here be appreciated that since edges 54*a*, 55*a* of coupler 21 do not block apertures 30 in coupler 21, and the rivet heads may pass therethrough in the enlarged portions of the apertures 30 to facilitate erection of shelving unit 10, including mounting of the beam onto the composite posts 17-20 even at the location of couplers 21. Flange 44 of beam 23, for example, in FIG. 8, is slightly spaced from the post flange by the partial intervention of the projection 59 therebetween.

It will also be appreciated that the invention may include other configurations of the beams 22, 23 suitable with end structures as depicted herein. For example, these beams and rivets so configured to be fitted onto the outside of the posts 17-20, with the beams lying on the reverse bend flanges 54, 55, for example. Other shelf-supporting elements formed in other such beams can be provided to produce shelving units of other configurations, such as where the surfaces of the shelves are disposed below the upper edges of the beams, for example.

Accordingly, this invention contemplates a post coupler in inside wrap form with flanges wrapping around the edges of an angular post from the inside and accommodates shelf-supporting beams disposed at their ends interiorly of the posts or alternately, on the outside of the posts, and the couplers accommodating beam supporting rivets without limit to the vertical beam position and shelves supported thereby within the height of the shelf unit corner posts including the areas where composite sections of the post are coupled.

These and other modifications and variations of the invention will be readily appreciated by the foregoing to those of ordinary skill in the art without departing from the scope of the invention and applicant intends to be bound only by the claims appended hereto.

What is claimed is:

1. A post coupler for use in a shelving unit having composite corner posts of two angular post sections having outer surfaces and comprising post flanges of predetermined thickness and having lateral edges, one post section atop another, each post section proximate a respecting abutting end with another post section having rivet receiving apertures therein, spaced from said lateral edges a first distance, for receiving rivets extending from end portions of horizontal, shelf-supporting beams, said post coupler comprising:

a pair of integral post coupler flanges disposed at an included angle respecting each other, said coupler flanges having exterior surfaces;

a reverse bend flange extending outwardly from each post coupler flange and for orientation along an exterior surface of a post flange, each reverse bend flange having a width less than said first distance, each reverse bend flange and each respective post coupler flange forming a gap therebetween as wide as said predetermined thickness for receiving a post flange therein; and a plurality of rivet receiving apertures in said post coupler flanges and of the same configuration as the rivet receiving apertures in the post sections for indexing with apertures in said post sections, when said coupler couples said post sections together and wherein said reverse bend flanges of said couplers have lateral edges extending laterally along said reverse bend flanges and spaced from said apertures in said post coupler flanges, and said coupler further including an upper edge and a lower edge, both said edges comprising a projection extending beyond ends of said reverse bend flanges for facilitating assembly of said coupler and said post sections.

2. The coupler as in claim 1 wherein each projection has an end extending longitudinally from said post coupler flanges, the distance between said ends of said projections defining the overall length of the coupler.

3. The coupler as in claim 2 wherein said reverse bend flanges have a length less than said overall length.

4. A shelving unit comprising composite corner posts of two angular post sections comprising post flanges of predetermined thickness having outer surfaces and having lateral edges, one post section atop and abutting another, each post section at a respecting abutting end with another post section having rivet member receiving apertures therein, spaced from said lateral edges a first distance, and at least one horizontal, shelf-supporting beam having rivets extending from end portions thereof, said post coupler comprising:

a pair of integral post coupler flanges disposed at an angle respecting each other, said coupler flanges having exterior surfaces;

a reverse bend flange extending outwardly from each coupler flange and oriented alongside an exterior surface of a post flange, each reverse bend flange having a width less than said first distance, each reverse bend flange and each respective post coupler flange forming a gap therebetween as wide as said predetermined thickness for receiving a post flange therein;

a plurality of rivet member receiving apertures in said post coupler flanges indexing with rivet member receiving apertures in said post sections, when said coupler couples said post sections together, and said rivet members of said beams extending through said apertures in said post coupler flanges and apertures in said post sections, wherein said coupler includes an upper projecting edge and a lower projecting edge, both said edges comprising a projection facilitating assembly of said coupler and said post sections.

5. The shelving unit as in claim 4 wherein said reverse bend flanges of said couplers are laterally spaced from said apertures in said post coupler flanges.

6. The shelving unit as in claim 4 wherein said reverse bend flanges terminate at upper and lower ends short of said projection edges.

7. The shelving unit as in claim 4 wherein said coupler has a predetermined length defined by ends of said respective projecting edges and wherein said reverse bend flanges have a length less than said predetermined length.

8. The shelving unit as in claim 4 further comprising:

at least one shelf-supporting beam mounted on said corner posts and onto post coupler flanges of said post coupler.

9. The shelving unit as in claim 4 further comprising:

a plurality of horizontally-oriented shelf-support beams having respective ends mounted to respective corner posts, said ends mounted against respective post coupler flanges on each corner post, a rivet member extending from an end of each beam through an aperture in a post coupler flange and through an aligned aperture in a corner post section.

* * * * *